US005387166A

United States Patent [19]

Gvoich

[11] Patent Number: 5,387,166

[45] Date of Patent: Feb. 7, 1995

[54] RECOILING EXERCISE BENCH

[75] Inventor: Ned Gvoich, Beamsville, Canada

[73] Assignee: Kor-One, Tempe, Ariz.

[21] Appl. No.: 164,014

[22] Filed: Dec. 8, 1993

[51] Int. Cl.[6] ..... A63B 22/04

[52] U.S. Cl. ..... 482/52; 482/51; 482/26; 482/27; 482/77

[58] Field of Search ..... 482/57, 143, 144, 140, 482/142, 77, 78, 31, 30, 51–52, 53, 96, 111–112, 26; 472/108

[56] References Cited

U.S. PATENT DOCUMENTS

| | | | |
|---|---|---|---|
| 1,638,356 | 8/1927 | Long | 482/77 |
| 3,195,890 | 7/1965 | Salls . | |
| 3,219,358 | 11/1965 | Hagner | 482/77 |
| 3,522,953 | 8/1970 | Gold et al. . | |
| 3,634,895 | 1/1972 | Childers . | |
| 4,196,903 | 4/1980 | Illustrato . | |
| 4,730,826 | 3/1988 | Sudmeier . | |
| 5,066,001 | 11/1991 | Wilkinson . | |
| 5,087,037 | 2/1992 | Morrow . | |
| 5,096,186 | 3/1992 | Wilkinson et al. . | |
| 5,108,089 | 4/1992 | Wilkinson . | |
| 5,112,045 | 5/1992 | Mason et al. . | |
| 5,116,044 | 5/1992 | Wilkinson et al. . | |
| 5,116,045 | 5/1992 | Jahoda . | |
| 5,118,096 | 6/1992 | Wilkinson et al. . | |
| 5,125,646 | 6/1992 | Wilkinson . | |
| 5,127,647 | 7/1992 | Wilkinson . | |
| 5,162,028 | 11/1992 | Wilkinson . | |
| 5,184,987 | 2/1993 | Wilkinson . | |
| 5,205,798 | 4/1993 | Lekhtman | 482/77 |
| 5,269,735 | 12/1993 | Pfitzenmeier | 482/52 |

FOREIGN PATENT DOCUMENTS

| | | | |
|---|---|---|---|
| 0183388 | 3/1907 | Germany | 482/31 |
| 3231033 | 2/1984 | Germany | 482/31 |
| 0700149 | 11/1979 | U.S.S.R. | 482/30 |
| 1172568 | 8/1985 | U.S.S.R. | 482/31 |
| 1710083 | 2/1992 | U.S.S.R. | 482/30 |

*Primary Examiner*—Richard J. Apley
*Assistant Examiner*—Jerome Donnelly
*Attorney, Agent, or Firm*—Small Larkin & Kidde

[57] ABSTRACT

An adjustable, recoiling aerobic exercise bench (20) which reduces the generation and transmission of impaction forces on a user's joints while performing conventional and power step exercises including a resilient platform (22) slidingly disposed in a left and right housings (36 and 38) which function to support the platform (22) above and relative to an exercise floor surface (42); a lateral platform recoiling assemblies is disposed between the platform ends (24 and 26) and inside lateral walls of the housings (36, 38) and adapted to generate lateral, resistive, restoring forces when platform (22) is moved downward during operation of the device (20); vertical platform recoiling assemblies (62), which includes a plurality of rigid tubular spring retainers, telescoping springs (90) mounted the undersurface of the platform and of sufficient length so as to make contact with the exercise floor surface (42) to thereby generate a vertical platform resistive restoring force when platform (22) is downwardly compressed.

11 Claims, 4 Drawing Sheets

RECOILING EXERCISE BENCH

BACKGROUND OF THE INVENTION

1. Field of The Invention

This invention relates to an improved, adjustable, recoiling aerobic exercise step bench. Adjustable height, aerobic step benches are widely accepted as a preferred means to facilitate aerobic training through exercise.

2. Description of the Related Art

Various types of step benches are available for use in an aerobic exercise program, in both the home and professional gym environments. Many of these devices provide for variation of the exercise intensity by providing adjustability of the bench height. However, recently the fitness industry has popularized a new aerobic stepping technique termed "power stepping." The conventional step aerobic exercises involve a simplistic step-up and step-down exercise technique. Power stepping technique is a substantially higher intensity and aggressive variation of the conventional technique and is best described as the vertical or lateral catapulting of the user's body off of the bench platform. The exerciser increases the lower limb range of motion and the speed of the muscle contraction and thereby the explosive force generated by the leverage of the joints and by the muscles of the lower limbs and buttocks. This power stepping is similar to the leap of a basketball player from a crouch prior to initiating a vertical leap toward a basket. Power stepping dramatically increases the aerobic intensity of the exercise as compared to a conventional bench stepping technique. However, the generation and transmission of the impaction forces to the exerciser's lower limb and spinal joints is proportionately increased with the power stepping technique.

It is well-documented that activities which generate and transmit impaction forces to the body's joints, such as jogging, are detrimental to the exerciser's joints. The avoidance or dampening of the generation or transmission of the impaction forces with respect to these types of exercising is therefore a desirable effect.

Various, related prior art exercise benches are known. However, none of these benches effectively address the problems associated with the generation and transmission of impaction forces to the exerciser's joints during their operation, especially during power stepping exercises. Certain prior art devices can reduce the potential for the generation and transmission of impaction forces; however, their inherent designs prohibit adaptation for use in an exercise bench.

There is, therefore, a need for a recoiling, aerobic exercise bench which effectively reduces the impaction forces generated by the operation of the bench and/or transmitted to the user's body joints while permitting variation in the intensity of the exercise by providing adjustability of the bench height.

OBJECTS OF THE INVENTION

Accordingly, it is an object of the present invention to provide a recoiling, adjustable aerobic bench which is an improvement over existing devices due to effectively reducing the physiologic stress associated with the generation of joint impaction forces while performing the conventional aerobic bench stepping exercise technique or the power stepping aerobic exercise technique.

Another object of the present invention is to provide a recoiling, adjustable bench device which remains stable and restricts creeping of the device along the exercise floor surface as the user reciprocally steps on and off of the device.

Yet another object of the present invention is to provide a recoiling, adjustable bench device which may be selectively and incrementally adjusted in its height to thereby permit sequential increases in the intensity of the associated exercise.

Another object of the invention is to provide a bench device which may be manufactured in two sizes: a shorter, compact size for home or apartment use and a longer size for use in the professional gym setting.

Still a further object of the invention is to provide a bench device which is simple to manufacture, affordable, light-weight, yet durable and reliable.

Other objects of the invention will become evident when the following description of this invention is considered with the accompanying drawings.

SUMMARY OF THE INVENTION

The present invention overcomes inadequacies of conventional aerobic bench devices by providing an easy to manufacture, light-weight, yet durable and stable recoiling, adjustable climbing exercise bench which effectively reduces the generation and transmission of impaction forces to the joints of the foot, knee, hip, pelvis and spine of a user while performing conventional or power stepping aerobic exercises, and including a provision for variably increasing the intensity of the exercise by the selective raising or lower of the bench platform height.

Accordingly, in general terms the device includes: a resilient, upwardly arched platform, slidingly mounted within a first channel of a left and right housing, a means for vertically and horizontally anchoring the platform, i.e., maintaining a stationary position of the platform with respect to an exercise floor surface; lateral recoiling assemblies disposed within a second housing channels adapted to generate a lateral resistive restoring force to the elongation of the platform during operation of the device; vertical recoiling assemblies having top ends secured to the platform undersurface and bottom ends in constant contact with the exercise floor surface and adapted to generate a vertical resistive restoring force to counter the downward displacement of the platform during operation of the device; a stop member mounted on each of vertical recoiling assembly and adapted to limiting the downward compression of the platform during operation of the device; and risers for variably adjusting the height of the device.

In more detail, the preferred embodiment of the present invention comprises: a substantially resilient, upwardly arched platform including substantially rounded end retainer bars rigidly attached at the left and a right platform ends and slidingly mounted within left and right second channels formed within a left and right housing so as to retain the platform above, an exercise floor surface, the housings having a lateral wall inclined from vertical at an acute angle so as to improve stability of the device during use; an elastomeric strip disposed within the left and right channels of the housings, between the end retainer bars and inside lateral walls of the housings, so as to form a lateral recoiling assembly adapted to generate lateral, resistive, restoring forces against the platform during operation of the device; housing end caps adapted to horizontally retain the platform within the first channels of the housings; a plurality of rigid tubular spring retainers, being of sufficient length and adapted to maintain constant contact with the exercise floor surface during operation of the device; a non-skid shoe mounted to the bottom end of the spring retainer so as to protect the floor surface and resist tipping or creeping of the device during use; a spring of predetermined compressibility mounted within the spring retainers and adapted to resist downward movement of the platform and thereby to generate a vertical recoiling of the platform during operation of the device; a shock absorbing rubber cylindrical collar, including a circular bore, slidingly disposed on the spring retainers so as to limit the downward movement; a plurality of attachable risers adapted to be selectively mountable to the left and right housings by the interengagement of groove mounting elements provided on the undersurface of the housings with a corresponding tongue mounting provided on a top surface of the risers so as to permit the risers to be slideably. engaged in a locking position with the housings, and including additional risers having corresponding grooves and tongues on their bottom and top surfaces so as to permit the selective mounting of risers to risers; and also including a plurality of risers adapted to be mountable to the bottom end of the spring retainers to permit a uniform, incremental adjustment in the platform height of the bench device.

DESCRIPTION OF THE PREFERRED EMBODIMENTS

Figure 1:
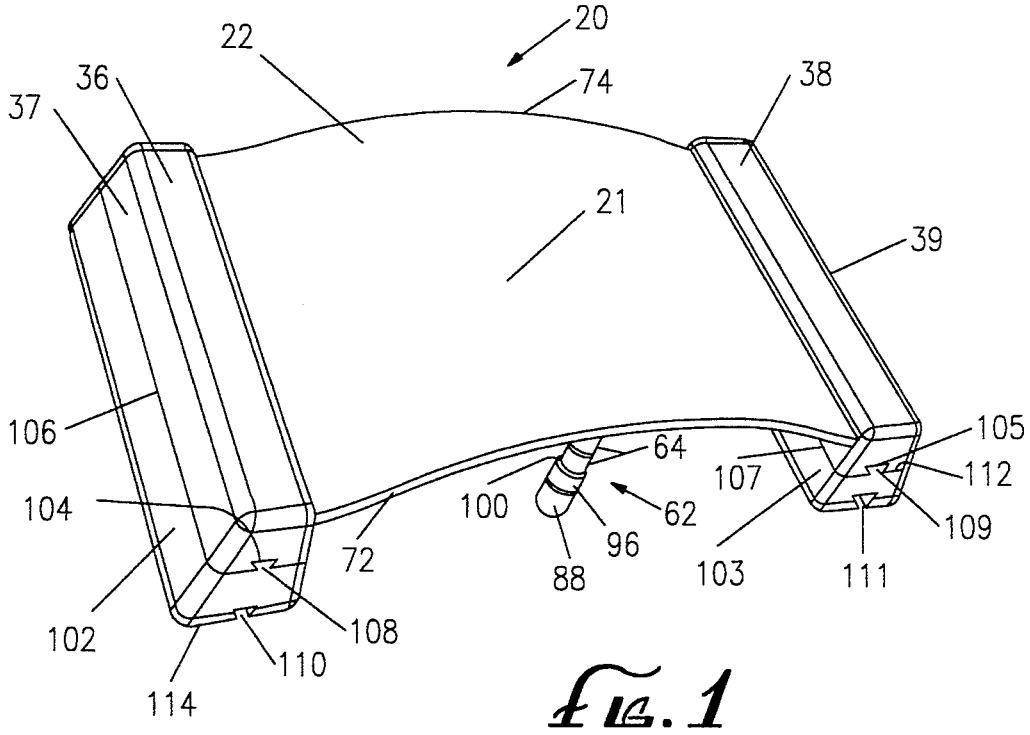
FIG. 1 is a perspective view of a preferred embodiment of the recoiling exercise bench of the present invention.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalents and alternative constructions falling within the spirit and scope of the present invention, as defined in the appended claims.

Figure 2:
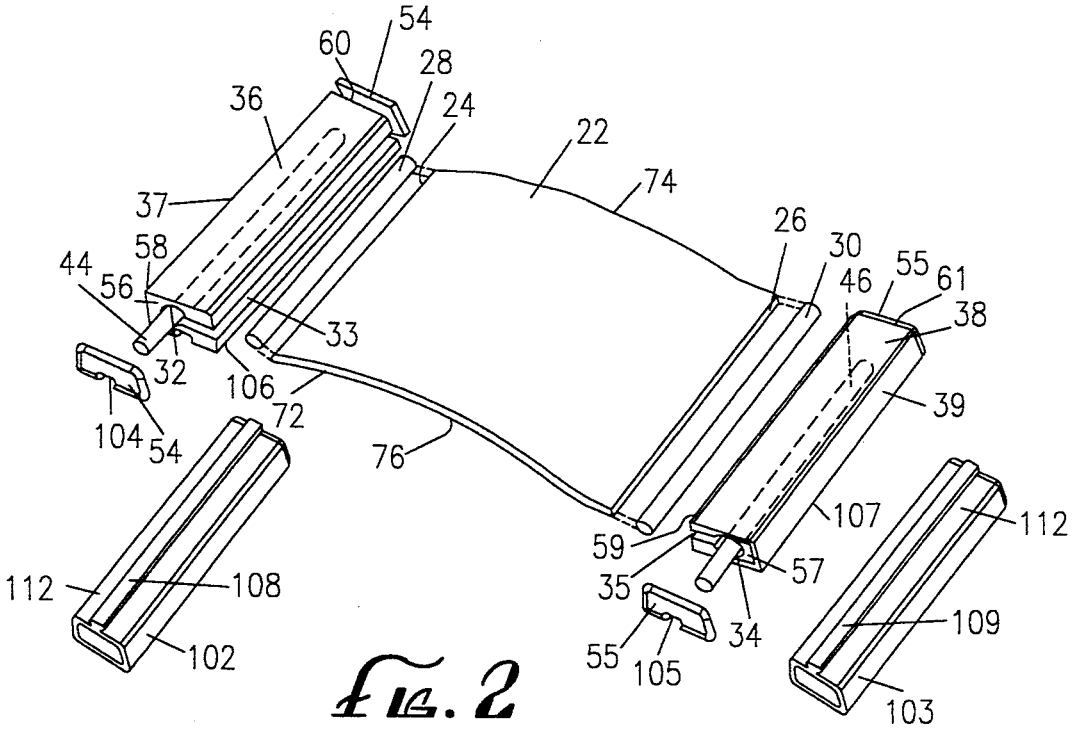
FIG. 2 is a partially exploded view of the recoiling exercise bench FIG. 1.
Figure 3:
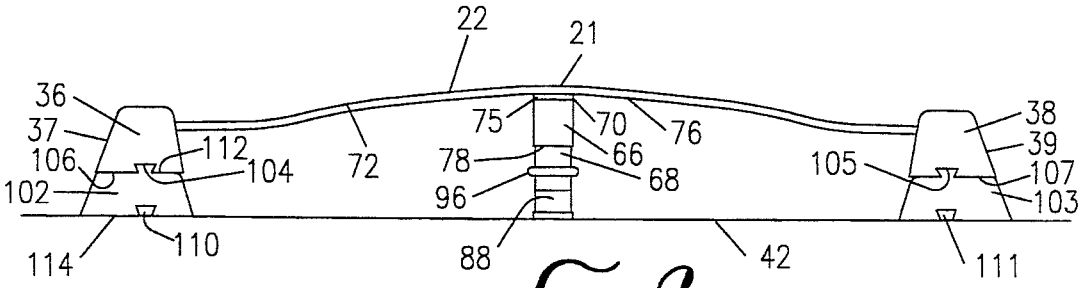
FIG. 3 is an front elevational view of the FIG. 1 bench.

As shown in FIGS. 1–3, a recoiling adjustable aerobic exercise bench 20 includes a resilient platform 22 of predetermined length and width sufficient to permit a full range of exercise movements associated with conventional and power step aerobic exercising. Platform 22 is preferably upwardly arched in cross-section with respect to the exercise floor surface 42 and with the apex 21 positioned intermediate the length of the platform 22. The platform 22 can be made using other cross-sectional configurations so long as the platform 22 cooperates with other components of the bench 20 to permit recoiling of the platform 22 during use of the bench 20. Platform 22 is preferably fabricated from a resilient and flexible plastic, although virtually any other resilient and flexible material, such as plywood, some metals or various woods, may be used.

Referring to FIG. 2 left end 24 and right end 26 of platform 22 include left and right platform retainer bars 28 and 30, respectively. The bars 28, 30 are substantially round in cross section and have a diameter large enough to keep them retained in second channels 32, 34 by the narrow height of first channels 33, 35 by the narrow height of first channels 33, 35. The left and right second channels 32 and 34, respectively, are integrally formed in the interior of left and right housings 36 and 38, respectively. The housings are preferably trapezoid in cross-section, with the bottom dimension greater than the top dimension, to provide increased stability. The bars 28 and 30 are, preferably, securely attached to platform ends 24 and 26, respectively, by any conventional means, but may alternately be integrally formed at the platform ends 24 and 26. Housings 36 and 38 include laterally and downwardly sloping lateral walls 37 and 39 which function to improve stability and prevent creeping of the bench 20 along exercise floor surface 42 during use. Bottom surfaces 106, 107 of the left and right housings 36 and 38, respectively, include grooves 104 and 105. The grooves 104, 105 are sized to accommodate complimentary tongues 108 and 109 on the top surfaces of risers 102 and 103. A plurality of risers 102 and 103 may be used to provide for adjustment of the height of the platform 22 above the floor 42. The tongue and groove features of the housings and risers 102 and 103 may have virtually any cross-sectional shape so long as they function to reliably fasten risers 102 and 103 to each other and the risers 102 and 103 to the housings 36 and 38. The grooves are preferably integrally formed in bottom surface 106 and 107 of the housings and on top surface 112 of the risers 102 and 103 so as to permit adjustment of the height of the housings 36 and 38 of the bench 20. Housings 36 and 38 and the risers 102 and 103 preferably are made from a substantially rigid material such as plastic, wood or metals sufficiently strong enough to vertically support and laterally secure platform 22 at a pre-determined distance above the floor surface 42 during use.

Figure 4:
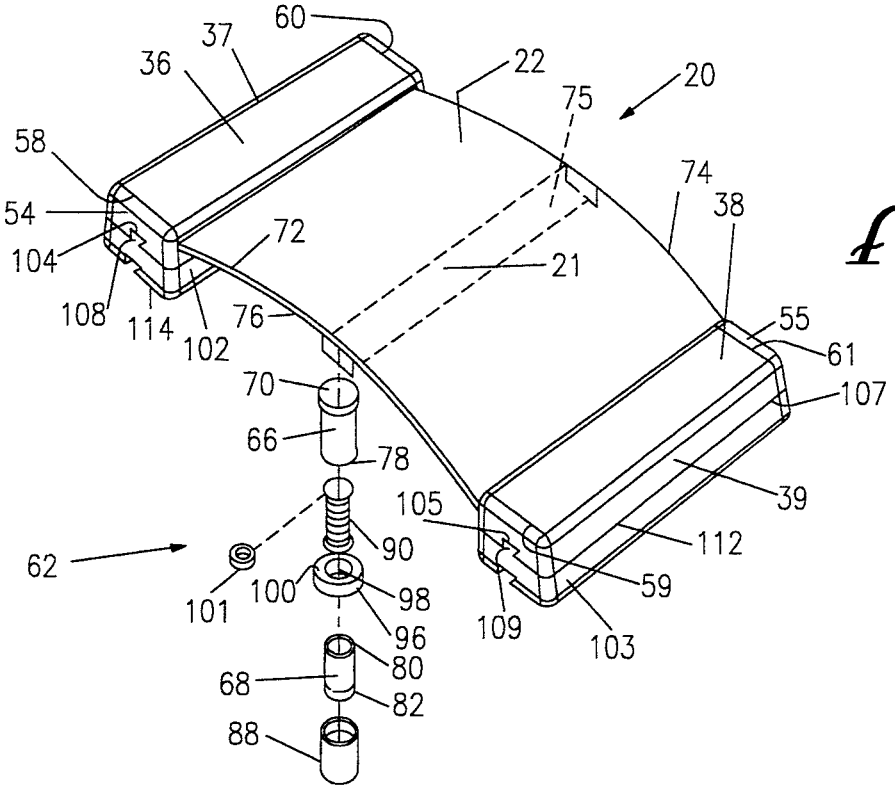
FIG. 4 is an perspective view of the bench of FIG. 1 showing the vertical recoil assembly exploded.
Figure 5:
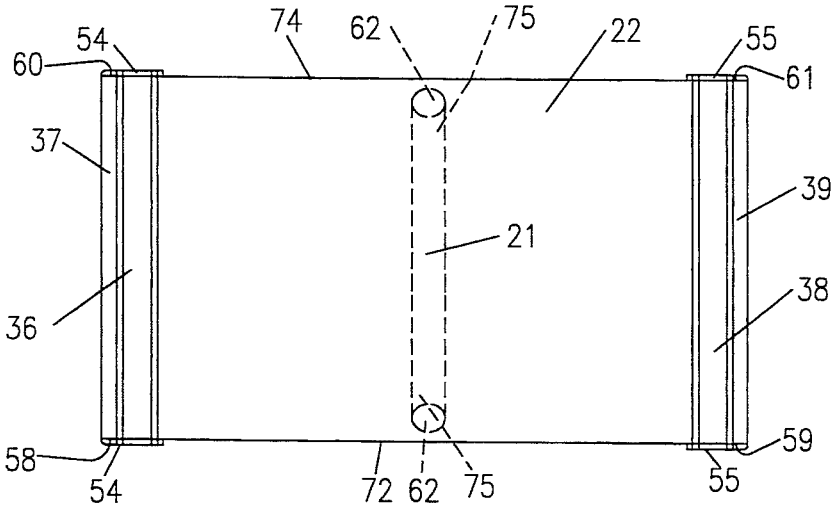
FIG. 5 is a top plan view of the FIG. 1 bench.
Figure 6:
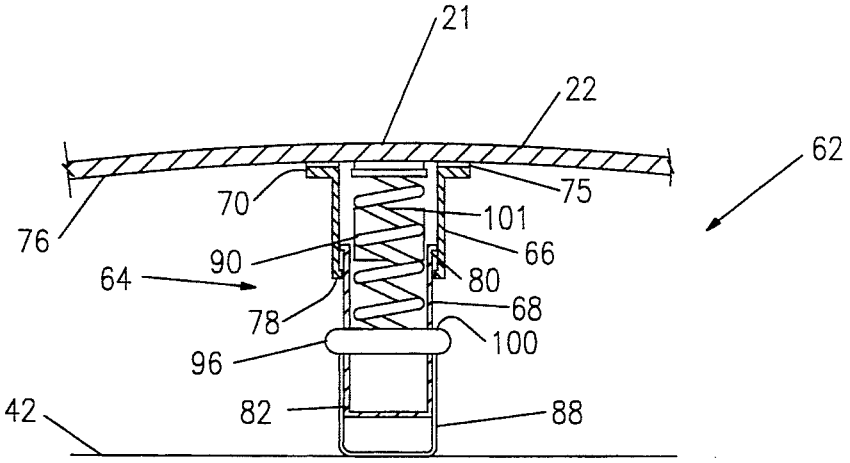
FIG. 6 is a partial cross-sectional view of a vertical recoil assembly of the FIG. 1 bench.

As best seen in FIGS. 2, 3 and 4, end caps 54, 55 are connected to open ends 56, 57 located at front edges 58, 59 and back edges 60, 61 of the housings 36 and 38 by any conventional means, such as by press fitting or by gluing. The end caps are sized and shaped to cover the openings and may be made from any material sufficiently rigid enough to prevent the left and right end retainer bars 28 and 30 from sliding out of the second channels 32 and 34 of housings 36 and 38, respectively, during use.

Figure 7:
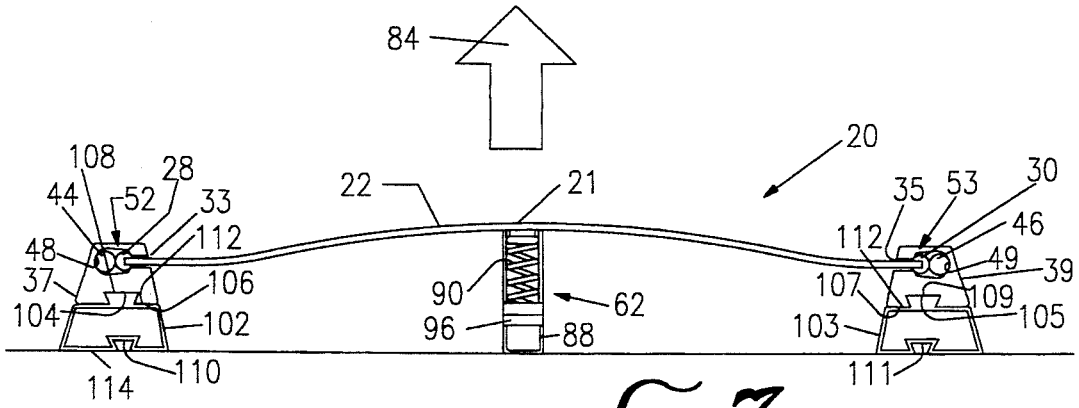
FIG. 7 is a front elevational view of the FIG. 1 bench showing attachment risers to the housings and the platform in a resting platform configuration.
Figure 8:
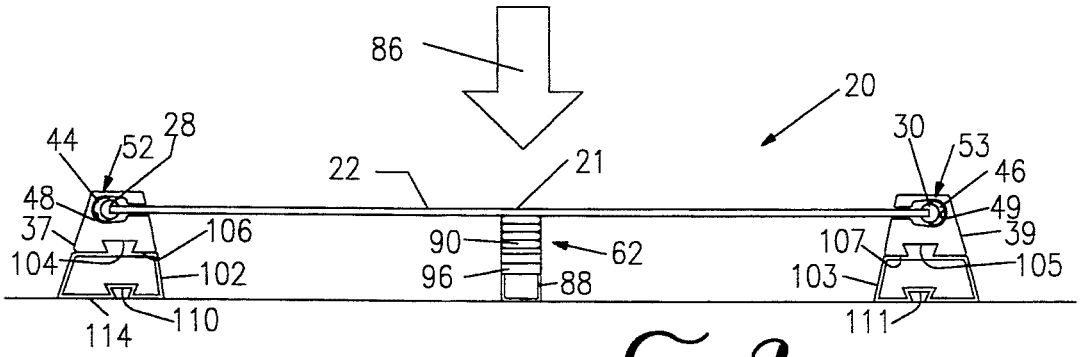
FIG. 8 is a front elevational view of the FIG. 1 bench showing attachment of risers to the housings, additional, separate risers, and the platform is a compressed configuration.

Referring to FIGS. 2, 7 and 8, lateral recoil assemblies 52, 53 include left and right elastomeric strip 44 and 46, respectively. The strips are of pre-determined compressibility and memory, disposed within lengthwise channels 32 and 34 of housings 36 and 38 and between inside lateral walls 48, 49 of the second channels 32 and 34 and the retainer bars 28 and 30 of platform 22, respectively. In FIG. 8, the strips 44, 46 are shown compressed and in FIG, 7 are shown relaxed. The strips function to resist the lateral forces generated by movement of arched platform 22 when platform 22 is downwardly compressed as shown in the direction of arrow 86 in FIG. 8. The strips also function to recoil platform 22 to its original shape as shown in FIG. 7. Elastomeric strips 44 and 46 may alternatively comprise springs, air cylinders or equivalents, so long as the strips function to provide lateral platform resistive and/or restoring forces to the platform 22 during operation of the bench 20. Alternatively, lateral recoiling means 52 and 53 may be eliminated if platform has sufficient recovery to return to original shape.

As best seen in FIGS. 4, 6, 7 and 8, a vertical recoil assembly 62 includes a rigid tubular spring retainer 64 formed by the rigid upper tube 66, which telescopes over rigid lower tube 68 of a smaller diameter. A top end 70 of the upper spring retainer tube 66 is mounted on undersurface 76 of platform 22. Preferably at least two vertical recoil assemblies 62 are fastened to the undersurface 76 of the platform. For example, assemblies 62 may be mounted intermediate the length of platform 22, at front edge 72 and at back edge 74, with a connecting plate or bar 75 spanning the platform 22 width and rigidly connecting spring retainers 64 at the top ends 70 so as to evenly distribute the downward compression forces, shown by arrow 86, exerted by the platform 22 into the vertical recoil assembly 62 during use of the bench 20. Bottom end 78 of the upper retainer tube 66 receives and engages with a top end 80 of the lower retainer tube 68 in a conventional manner, such as with complimentary inner and outer lips, or flanged ends, respectively. The length of the telescoping upper tube 66 and lower tube 68 is sufficient to maintain bottom end 82 of the lower retainer tube 68 in constant contact with the exercise floor surface 42 through a non-skid shoe 88. Shoe 88, of a predetermined length, functions to protect the exercise floor surface 42 and resist creeping of the bench 20 along the floor surface 42. Shoe 88, of course, may be made of different lengths, and/or made to be adjustable in height so as to provide for the selective, uniform and incremental raising of the bench 20 to thereby provide for variation in the intensity of the exercise by providing for adjustment of the vertical distance of motion permitted the platform 22 during use. Spring retainer 64 is preferably formed of metal but may be formed from any substantially rigid material including numerous plastics.

In each assembly 62 a spring 90, of predetermined load capability, spring constant and size is mounted within the tubular spring retainer 64. Spring 90 functions to resist the downward compression, shown at arrow 86 in FIG. 8, of platform 22 and to restore platform 22 to its original shape as at arrow 84 during operation of the bench 20. Air cylinders or other equivalent means may be used as substitutes for the springs 90, so long as they function to resist compression of platform 22 and restore platform 22 to its original configuration during operation of the bench 20.

Referring to FIG. 4, rubber, shock absorbing cylindrical collar 96, including a circular bore 98 is slidingly disposed around the lower retainer shaft 68 of the assembly 62. The collar functions to limit downward travel of the upper retainer shaft 66 on the lower shaft 68 by the abutment of the bottom end 78 of the upper tube 66 with an upper end surface 100 of collar 96 when the platform 22 is fully compressed. The maximum length of downward travel of spring retainer 64 is determined by the vertical dimension of collar 96. A plurality of cylindrically shaped rubber stoppers 101, shown in FIG. 6, may be selectively mounted between any two or more coils of spring 90 so as to stiffen springs 90 and thereby permit adjustment of the compressionability of spring 90 and to accommodate exercisers 118 of different body weight. Spring 90 may alternatively be substituted with an elastomeric material, air cylinder or other equivalent means so as to eliminate the need for spring retainer 64, collar 96 and stopper 101 so long as the vertical recoil assembly 62 has recoiling properties sufficient to function as a platform resistive and restoring force during operation of the bench 20. Spring 90 may be made from any compressible shock absorbing material suitable for spring construction. Stopper 101 may be made from any substantially stiff material.

As best shown in FIGS. 7 and 8, the left risers 102 and right risers 103 include tongues 108, 109 integrally formed in top surfaces 112 and complimentary grooves 110, 111 integrally formed in bottom surface 114 of the risers 102 and 103 so as to permit the selective attachment of risers 102 to the bottom surface 106, 107 of the housings. Selective attachment of a additional left and right risers 102 and 103 to the bottom surface 114 of attached risers 102 and 103 may also be accomplished in a similar fashion and as illustrated in FIGS. 7 and 8. Also, non-skid shoes 88 of varying dimensions may be attached to the bottom ends 82 of spring retainer 64 so as to provide for the incremental raising or lowering of the platform 22 of the bench 20. The risers 102 and 103 attached to the bottom surface 114 of the risers 102 and 103, combined with the plurality of variable height, non-skid shoes 88 attached to the bottom ends 82 of spring retainers 64 provide for the incremental raising or lowering of the platform 22 of the bench 20. The risers 102 and 103 and shoes 88 may be formed of any substantially rigid material such as rubber, plastic, wood or metal.

Where used here to describe the preferred embodiment, the terms "integral" and "integrally formed" mean that the parts referred to are portions of a single unit, preferably a plastic, wood or metal material, and formed using a injection molding, blow molding, extrusion molding or casting molding fabrication process. However, other forms of attachment may be suitable, consistent with minimizing production cost and enhancing reliability. The term "rigid" means that the parts referred to are preferably made of tubular-shaped plastic or metal materials. The terms "rigidly attached" or "rigid attachment" mean that the parts referred to are screwed, glued or otherwise fastened together.

Figure 9:
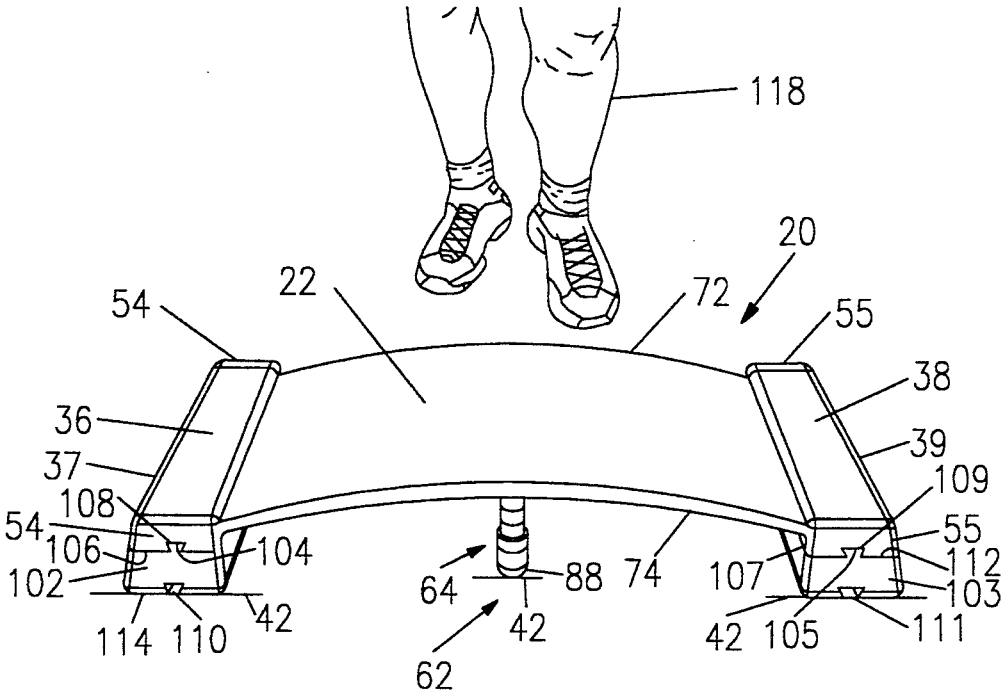
FIG. 9 is a perspective view of the FIG. 1 bench during use by an exerciser and demonstrating the resting or recoiled configuration of the platform.
Figure 10:
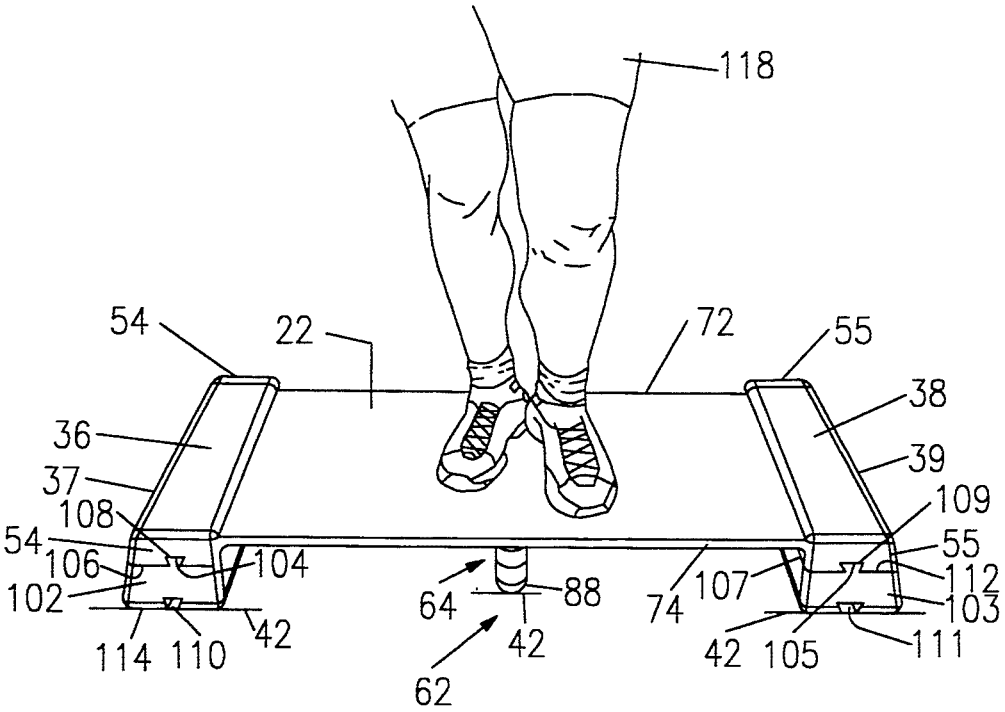
FIG. 10 is a perspective view of the FIG. 1 bench during use by an exerciser and demonstrating the loaded, weighted or compressed configuration of the platform.

Referring to FIGS. 9 and 10, operation of the bench 20 of the present invention will be described. A person 118 is shown stepping onto, and off from, the platform 22 of the bench 20 after adjustment of the platform 22 height by the selective attachment or detachment of left and right risers 102, 103 to the undersurfaces 106 of the housings 36 and 38, respectively. The attachment of risers 102, 103 to the housings and the selective attachment of shoes 88 to the bottom end 82 of spring retainers 64 is accomplished so as to select the desired exercise intensity, according to the platform 22 height. The platform 22 is shown in FIG. 9 in a relaxed position wherein no weight is borne on the platform 22 and in FIG. 10 is shown in a fully compressed position. It may be seen that platform 22 distorts, under the user's body weight, by the flattening of the platform 22 arch toward the floor surface 42 and by the lateral movement of the edges of the platform 22 away from first channels 33, 35 into the second channels 32 and 34 of housings 36 and 38 and against the elastomeric strips 44 and 46 supported by the inside wall 48, 49 of the second channels 32 and 34. The combined operation of the housings 36 and 38, the second channels 32 and 34, the recoiling elastomeric strips 44 and 46, the telescoping recoiling spring retainers 64 and springs 90 permit the lateral and vertical distortion of the platform 22 while preventing the creeping of the bench 20 along the floor surface 42.

In use, the exerciser's 118 stepping maneuvers are assisted by the recoiling response of the platform 22. Immediately upon stepping onto the platform 22, the exerciser 118 initiates an upward thrusting of his or her body, the bottoming out of the spring retainer downward travel 94 being prevented by springs 90, collar 96, stoppers 101, and shoes 88. The springs 90 are preferably of sufficient compression strength so as to counter the exerciser's 118 weight. The compression strength and operation of the springs may be modified by the selective attachment of rubber stoppers 100 between any two coils of springs 90. Also, abutment of the upper spring retainer shafts 66 into the top end surface 100 of collars 96 contribute to the operation of the device by further limiting and modifying the vertical travel of the platform 22, and in conjunction with the rapidity of the exerciser's movements, provide a springing assistance to the exerciser's 118 stepping maneuvers as the exerciser 118 performs power step exercises on platform 22, thereby effectively reducing the generation and the transmission of impaction forces to the body joints of the exerciser 118.

What is claimed is:

1. An exercise device comprising:

a platform having a thickness, a top side, a bottom side, a first edge and a second edge extending along a length dimension, and a third edge and a fourth edge extending along a width dimension;

a left housing having a top wall, a bottom wall, a first side wall and a second side wall, the housing extending along the third edge of the platform and the second side wall having a first channel of predetermined height and length formed therein;

a right housing having a top wall, a bottom wall, a first side wall and a second side wall, extending along the fourth edge of the platform, the second side wall having a first channel of pre-determined height and length formed therein;

the third edge and fourth edge of the platform each having a retainer bar attached thereto each retainer bar having a cross-sectional dimension greater than the thickness of the platform, and of the height of said first channels, respectively; and a floor surface engagable vertical recoil assembly positioned on the bottom side of the platform intermediate said third edge and said fourth edge and including means to resist forces applied to the platform from the direction of its top side to its bottom side sufficient to function as a platform resistive and restoring force during operation.

2. The exercise device of claim 1 wherein the platform is convex with the third and fourth edges closer to the support surface than the center portion of the platform.

3. The exercise device of claim 1 wherein the left and right housings are of trapezoidal cross-section, with the bottom wall of the left housing and bottom wall of the right housing having a width greater than the width of the top wall, so as to provide greater surface area on the bottom of the housing than on the top of each housing.

4. The exercise device of claim 1 further including first and second lateral recoil assemblies positioned in the left and right housings, respectively, between the first side wall and the channel of each housing, respectively, and including means to resist lateral forces applied to the third edge retainer bar and fourth edge retainer bar.

5. The exercise device of claim 1 wherein the vertical recoil assembly includes a spring.

6. The exercise device of claim 5 wherein the spring further includes a stopper mounted between any two coils of the spring.

7. The exercise device of claim 6 wherein the stopper is made of an elastomeric material.

8. The exercise device of claim 6 wherein the spring is retained by an upper tube member and a lower tube member, the upper and lower tube members adapted for telecoping relationship each to the other.

9. The exercise device of claim 8 further including a stop member mounted on the lower tube and adapted to limit the downward displacement of the platform during use of the device by abutment of a lower end of the upper tube with the top surface of the stop member.

10. The exercise device of claim 1 further including a plurality of left and right risers, the risers each having a top wall, a bottom wall, a first side wall and a second side wall, each left riser having a cross-sectional configuration substantially identical to the cross-sectional configuration of the left housing, and each right riser having a cross-sectional shape substantially identical to the cross-sectional shape of the right housing.

11. The exercise device of claim 10 wherein the top wall of the left riser and top wall of the right riser each include a tongue-shaped mounting element formed thereon, extending along the length of the riser corresponding to the third edge and fourth edge of the platform, respectively, and the tongue shape adapted to the slidingly retained within a complimentary shaped groove on the bottom wall of the left housing and right housing, respectively.

* * * * *